United States Patent [19]

Nutter

[11] Patent Number: 4,929,148

[45] Date of Patent: May 29, 1990

[54] TURBINE TRIP THROTTLE VALVE CONTROL SYSTEM

[75] Inventor: Norman E. Nutter, Lunenburg, Mass.

[73] Assignee: General Electric Company, Schenectady, N.Y.

[21] Appl. No.: 289,842

[22] Filed: Dec. 27, 1988

[51] Int. Cl.[5] ..... F01D 21/00

[52] U.S. Cl. ..... 415/32; 415/36; 415/43

[58] Field of Search ..... 415/29.32, 36, 43

[56] References Cited

U.S. PATENT DOCUMENTS

| | | | |
|---|---|---|---|
| 3,446,225 | 5/1969 | Townsend | 415/43 |
| 3,614,457 | 10/1971 | Eggenberger | 415/32 X |
| 3,669,559 | 6/1972 | Sakamoto et al. | 415/43 X |
| 4,658,590 | 4/1987 | Higashi et al. | 415/36 X |

*Primary Examiner*—Everette A. Powell, Jr.

*Attorney, Agent, or Firm*—Nixon & Vanderhye

[57] ABSTRACT

Combination trip and throttle valve steam controls for a steam turbine include manual controls to actuate the trip mechanism and shut the turbine down and a trip/reset, with a single control to regulate the steam delivered to the turbine and to reset the trip mechanism to provide simplified and reliable controls.

31 Claims, 3 Drawing Sheets

TURBINE TRIP THROTTLE VALVE CONTROL SYSTEM

BACKGROUND OF INVENTION

This invention relates to hydraulic control systems for steam turbines of the type used for marine use or for power generation, and more particularly to combination steam or speed and tripping control systems for such turbines. The high pressures and high speeds present in modern turbine operation require control systems for the supply of steam to the turbine which are reliable, positive in operation, and readily accessible for actuation by the operator. Failure of protective controls for the turbine could lead to extensive damage to the turbine and surrounding buildings, or to a ship in the case of marine use. Hydraulic control systems are commonly used for turbine control and consideration must be given in their design to operation and reliability. However, it is desirable to optimize the ease of control while insuring and improving control system operation, particularly in regard to trip throttle valve control, of the steam valve which controls the main steam flow to the turbine, and which is used to shut the turbine down in the event of malfunctions of the system. With the growing complexity of turbine control systems, it is desirable to minimize the number of controls and to facilitate ease of operation whenever possible. This is particularly true for controls relating to overspeed or manual trip and reset of the turbine.

OBJECTS AND SUMMARY OF INVENTION

It is an object of the present invention to provide an improved steam turbine trip valve control system.

It is a further object of the present invention to provide an improved turbine trip valve control system incorporating improved flexibility of operation while providing reliability through two-out-of-three trip logic controls.

It is a still further object of the present invention to provide improved turbine trip valve control elements which are convenient and easy to use.

With the above objects in view, the present invention resides in an improved steam turbine hydraulic control system in which a throttle valve regulates the steam delivered to the turbine and a trip mechanism is included for shutting the steam turbine down. Means are included to manually trip the turbine control and a single control is provided to control the steam to the turbine and to reset the control once tripped. The manual trip may be actuated from either of two locations, and a two-out-of-three logic valve control is provided to provide increaed reliability and versatility.

BRIEF DESCRIPTION OF DRAWINGS

Referring to FIG. 1, there is shown diagrammatically the main steam valve 1 for the steam turbine 18 which is actuated by the trip throttle valve operator 2 which includes a positioner piston 3, a power piston 4 and an operator dump valve 5. The general structure and operation of trip throttle valves are well known in the art.

Figure 1:
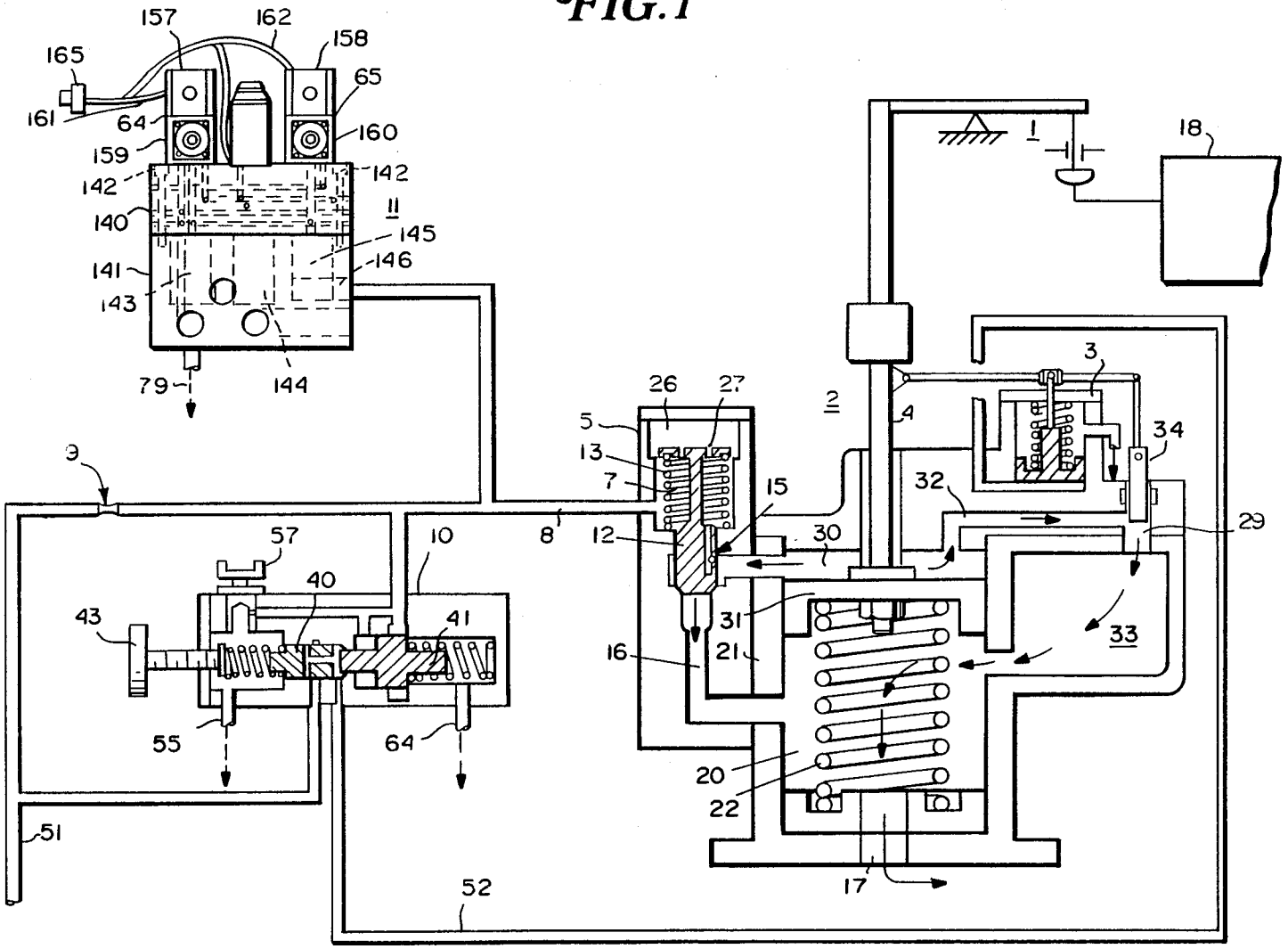
FIG. 1 is a diagram showing a trip throttle valve control system for a steam turbine.

However, by way of a brief explanation, it is to be noted the oil pressure is delivered to the operator dump valve 5 through trip header oil line 8 from which is supplied oil or other hydraulic fluid from oil supply line 51. Under shutdown conditions oil flows through orifice 9 to operator dump valve 5 where it passes through the chamber 7 through drain line 16 and out through drain port 17 after passing through the chamber 20 of the power piston 21. When shutdown conditions exist, oil also flows through other trip valves in the system shown in FIG. 1. It is to be noted that the coil spring 22 of the power piston 21 urges the power piston 31 upwards. However, the oil pressure at trip header 8 is sufficient in the chamber 26 above piston 27 to force the valve 12 downward against the bias of spring 13, covering drain port 15. The drain port 15 is thus covered during operation of the turbine 8. However, when the pressure in trip header 8 falls, upon actuation of either the trip/reset valve 41 or manifold trip solenoid valves 11, spring 13 forces valve 12 upward opening drain port 16 which allows the oil flow from chamber 30 in the direction of the arrows, through drain line 16, through drain chamber 30, and out through drain port 17 to drain.

Figure 2:
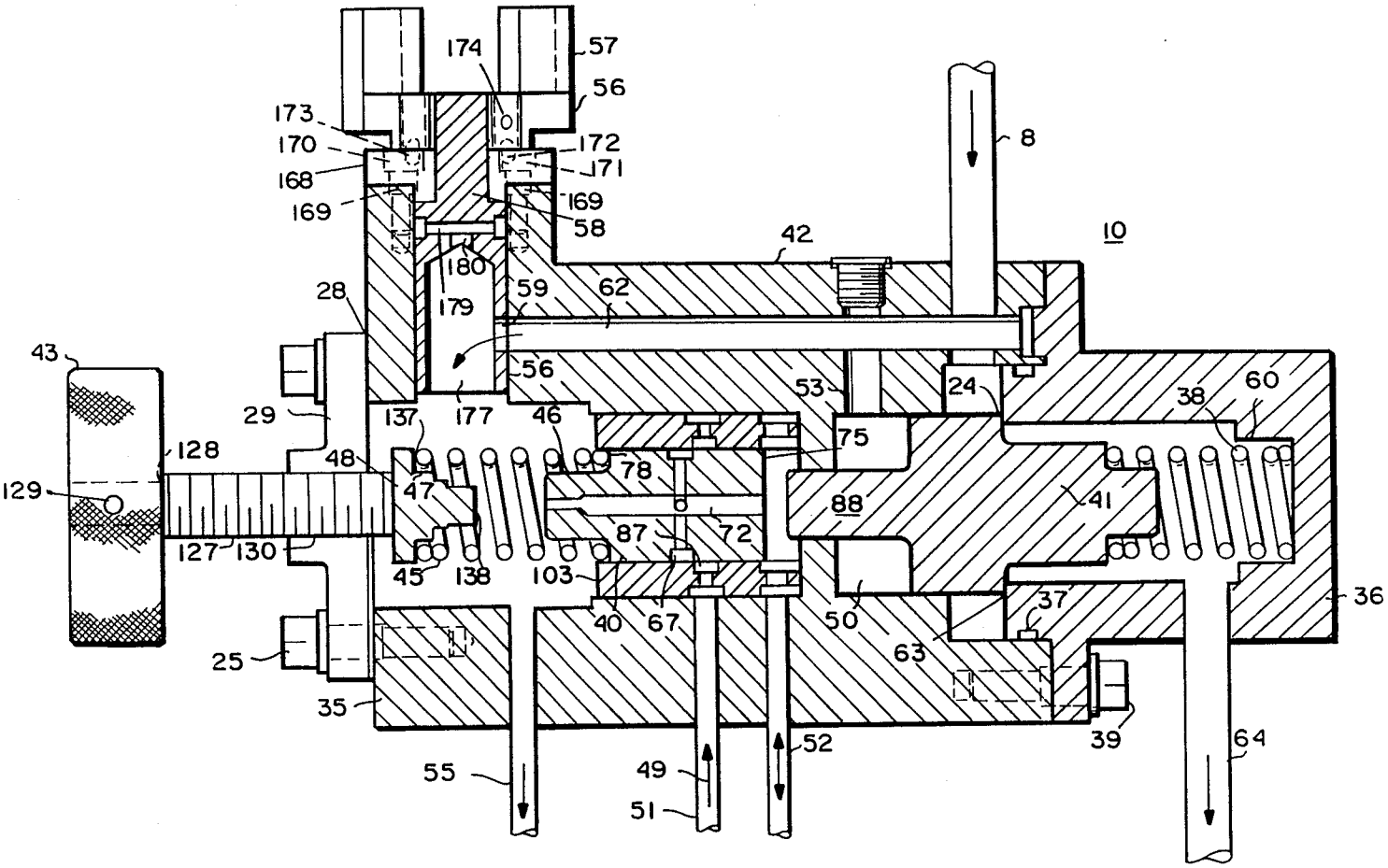
FIG. 2 is a detailed cross section of the trip throttle valve operator control shown in FIG. 1.

An improved trip throttle valve (or TTV) operator control 10 in accordance with the present invention is shown in more detail in FIG. 2. Referring to FIG. 2, the TTV control 10 includes a pressure regulator valve piston 40 and trip/reset valve piston 41 within the unitary or integral valve housing 42. A handknob 43 allows the operator to adjust the bias or pressure of coil spring 45. Spring 45 is a helical coil compression spring with squared off ground ends positioned between the shoulder 46 of pressure regulator valve piston 40 and the shoulder 47 of the handknob spindle 48. The hydraulic oil supply delivers oil or hydraulic fluid 49 at approximately 100 PSIG (pounds per square inch) to oil supply line 51 in the direction shown by the arrow. The pressure regulator piston 40 is a spring loaded balance piston which bleeds more oil to the output port 52 of the valve as the spring 45 load is increased. The handknob 43 is used by the operator to control the pressure provided by the control oil which passes through the pressure regulator valve piston 40 to supply 20–80 PSIG control oil to the controlled pressure line 52. The control oil is used to control the position of the steam valve 1 through positioner piston 3 and power piston 4, and thus control the steam to turbine 18. The increased oil flow through pressure regulator valve piston 40 increases the output pressure which acts as a restoring force to the pressure regulator valve piston 40, counteracting the spring force. Manual operation of the handknob 43 moves pressure regulator valve piston 40 controlling the amount of exposure of the port 67 of the valve to the oil supply line 51.

The TTV operator control 10 also includes a hand trip control valve 56 which is actuated upon rotation of handknob 57 to trip the turbine for shutdown under emergency conditions. Since handknob 57 is located at the operators speed control, the handknob 57 is conveniently located for the operator, and is very readily accessible in case of an emergency requiring emergency trip of the turbine 18. The location of a convenient quickly operable trip right at the operating position provides flexibility in locating the operator and necessary controls at a convenient location. Referring again to FIG. 2, the hand trip control knob 57 is secured to the rotary plug or trip valve 58 having a trip port 59 which when rotated approximately 75 degrees by rotation of the hand trip control knob 57 becomes aligned with line 62 which connects to trip header line 8 allowing the oil in the trip header line to dump through drain port 59 of the hand trip control valve 56, dropping the oil pressure in the trip header line 8 and closing the steam valve 1 in the manner described above to shut down the steam turbine. The drop in the oil pressure in trip header 8 allows the trip valve spring 38 to push the trip/reset valve piston 41 to the left uncovering drain 64 to keep the trip header 8 pressure from building up until the control system is manually reset as described below.

Thus, once tripped, the TTV operator control 10 stays tripped until reset. Resetting is readily accomplished by first closing off the hand trip control valve 56 by rotation of the trip port 59 out of alignment with line 62. Handknob 43 is then rotated manually moving pressure regulator valve piston 40 all the way to the right in FIG. 2 to contact the projection 88 of trip/reset valve piston 41 and move valve piston 41 to the right against spring 38 closing drain port 63 so that oil no longer drains out of the bottom of drain 64 and piston 41 is held in the reset position by oil pressure in chamber 50. Pressure is then reestablished in trip header 8 allowing the pressure regulator valve 40 to resume control of the steam valve 1 to restart and control the steam to turbine 18.

Thus, the pressure regulator valve piston 40 and the trip reset valve 41 have been combined such that a single control, handknob 43, operates both, simplifying the structure and operation of the controls. This facilitates convenient location of the control for ready access and operation by the operator, particularly when combined with the integral hand trip valve 56.

The normal pressures in one application of the present invention, provided by way of example, of the control characteristics, are with a supply oil pressure of 100 PSIG (pounds per square inch), and with the trip valve operator 2 open, the trip header pressure 8 is 95 PSIG; the trip throttle valve cylinder is at 90 PSIG; and positioner piston 37 is at 0 PSIG.

Referring again to FIG. 2, in constructing one embodiment of the trip throttle valve operator control 10, the integral valve housing 42 is made in two sections, housing section 35 on the left, and housing section 36 on the right, bolted together by bolts 39. Section 35 includes the pressure regulator valve 40, hand trip control valve 56, and trip/reset valve 41 cylinder 50. This section includes drilled interconnecting passageways from the trip/reset oil supply, the trip header 8, to the trip/reset cylinder 50 through passageway 53, and to the hand trip valve 56 through passageway or line 62. Oil connections are also included in the housing for supplying oil to the pressure regulator through oil supply line 51, and to supply controlled oil pressure from the regulator through controlled pressure line 52. Drain line 55 is included for the pressure regulator valve 40 leakage as well as the hand trip valve 56 leakage and dump oil. The second section 36 of the housing 42 acts as the valve seat for the trip/reset valve 41, the housing for the trip valve coil spring 38, and the trip oil dump drain 64 from the trip/reset valve 41. An O-ring 37 provides a static seal for the two sections 35 and 36 of housing 42 to seal against oil leaks, while a gasket 28 is provided to seal the spring screw cover 29 from oil leaks. The cover 29 is bolted to housing section 35 by bolts 25.

The trip/reset valve piston 41 is made of bronze to provide good sliding material compatibility. The drain 64 end of the housing section 36 includes a projection 24 which provides a bearing surface for the trip/reset valve 41 for the reset position. The drain 64 end includes a spring guide projection 60 for aligning the spring with the trip/reset valve. The trip spring 38 is exactly the same as the pressure regulator valve spring 45 so that mixup up the springs in manufacture or maintenance cannot provide a problem. The spring force on trip spring 38 in the reset position is 40 pounds.

Referring to the pressure regulator valve 40, a bushing 103 around the valve piston, provides for material compatibility for the sliding surfaces, and provides machined grooves for good cutoff porting of the oil flow through the valve. The valve piston 40 has a shoulder or spring seat 46 and a groove 67 around the outside circumference with cross drilled holes for supply oil provided at groove 67, and a center hole 72 from the controlled pressure end 75. One edge of groove 67 lines up with one edge of the groove 89 of bushing 103 to form a cut-off edge for dropping oil pressure from the 100 PSIG supply pressure from pipe 51 to the controlled pressure provided at pipe 52, depending on the amount of compression of spring 45. The spring 45 seat has a projection 78 which acts as a spring guide and also as a bearing surface for the spring 45 when the pressure regulator valve piston 40 acts as a spacer to push the trip/reset valve 41 to its reset position. The spring 45 is a helical coil compression spring with squared off, ground ends. The spring 45 counteracts the force from the controlled pressure at the opposite end from handknob 43 with maximum spring force being approximately 123 pounds. The handknob 43 is threaded to the spring seat screw 127 and tightens against a shoulder 128 on the spring seat screw and is locked in position by a 0.25 inch diameter pin 129. The end cover 29 includes a threaded central hole 130 for the threaded spring screw 127. The spindle 48 on the spring screw 127 includes a spring seat 137 facing the pressure regulator valve 40 piston, and a flattened end 138 which contacts the piston 40 for the reset portion of the stroke.

The hand trip control valve 56 includes a mounting plate 168 which is secured to the housing section 35 by bolts 169. The mounting plate 168 acts as a vertical positioning means for the rotary trip valve 58 and trip handle 57, and includes shallow drilled holes 170 and 171 for the ball-spring detent plungers 172 and 173 in the trip handle. In addition, stop pins (not shown) limit the extremes of the trip handle 57 rotation. The rotary trip valve 58 is cylindrical with the bottom end drilled for a drain hole 177 and one radial hole 59 to line up with the trip oil passage or line 62 when the trip valve 58 is rotated to the trip position. A drain groove 179 with a crossed drilled hole intersecting with the bottom drain hole 180 prevents valve leakage flow from reaching the top of the assembly and causing leaks through mounting plate 168. The upper stem of the trip valve 58 fits through the mounting plate 168, and after positioning the trip handle to the stem, the hole is drilled and a pin (not shown) inserted to lock the valve 58 and handle or knob 57 with the mounting plate 168 sandwiched between them. The detent plunger 173 is a spring loaded ball in a threaded cylinder and holds the trip handle or knob 57 in either the trip or reset position in a positive manner as the ball lowers into the shallow holes 170 of the mounting plate 168. The trip handle 57 rotates approximately 75 degrees as the trip or reset tab is pushed.

The dump valve 5 in FIG. 1 is actuated upward by coil spring 13 when the pressure in trip header 8 falls upon trip action of the trip/reset valve 41 or the solenoid valve trip 11. The oil supply at orifice 15 is blocked and piston coil spring 22 forces the piston upward and oil from line 30 drains through drain line 16, chamber 20, and drain passage 17. The operation of the manifolded trip solenoid valves 11 is best understood with reference to FIG. 3.

Figure 3:
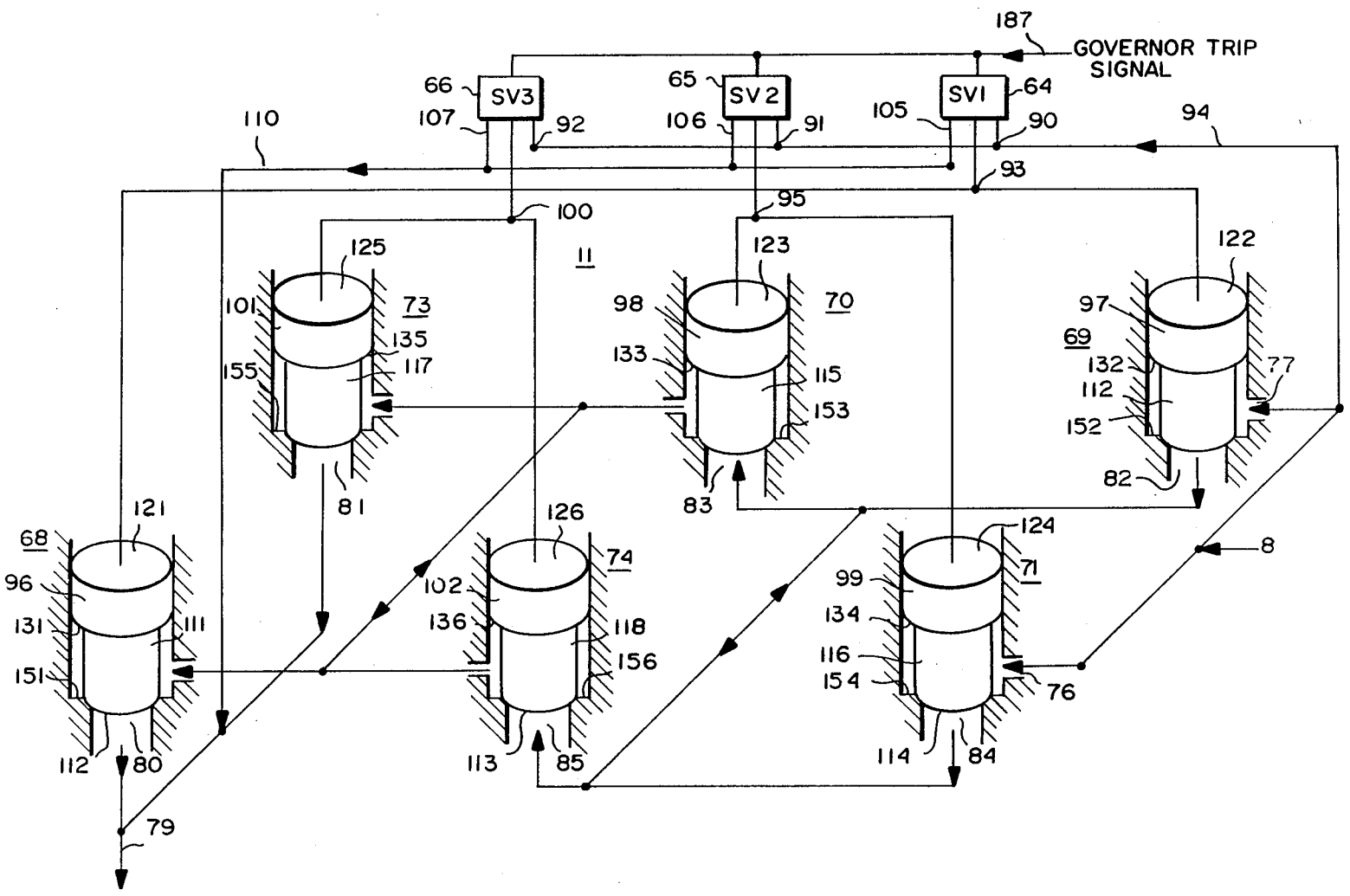
FIG. 3 is a diagram illustrating the two-out-of-three trip solenoid control incorporated in the control system of FIG. 1.

Referring to FIG. 3, there is illustrated the redundancy (and resultant reliability) of the trip solenoid valve assembly 11. The unit provides a dual stage valve arrangement to accomplish a 2-out-of-3 hydraulic overspeed trip. The first stage uses very small direct current (DC) solenoid spool valves 64, 65 and 66 which each act as pilot valves for two other pilot operated dump valves. Solenoid valve 64 acts as a pilot valve for dump valves 68 and 69, solenoid valve 65 acts as a pilot valve for dump valves 70 and 71, and solenoid valve 66 acts as a pilot valve for dump valves 73 and 74. The dump valves are sometimes referred to as logic elements, and are interconnected for the 2-out-of-3 logic as shown, such that an open failure of one will not prevent tripping as called for by the other two. The trip header 8 is connected to the ports 76 and 77 of dump valves 71 and 69 respectively. The trip manifold drain 79 is connected to the drain ports 80 and 81 of dump valves 68 and 73, respectively.

The trip solenoid valve assembly 11 thus utilizes a two stage valve arrangement in place of a one stage solenoid valve previously used, resulting in smaller size, lighter weight, and the ability to drive the smaller solenoid valves 64, 65 and 66 directly from the turbine governor system without the need for external electric relays. Each of the solenoids 64, 65, 66 is the initial stage controlling two logic elements or poppet valves, 68–69, 70–71, and 73–74, respectively. The six logic elements or valves 68, 69, 70, 71, 73 and 74 are interconnected by generous sized drain or dump passageways 80, 82, 83, 84, 81 and 85 respectively, for the two-out-of-three logic circuit. The solenoid valves 64, 65 and 66 are supplied with 30 volts DC (direct current) from the governor trip circuits which provide a trip signal 187 when the speed of the turbine 18 exceeds a predetermined safe speed. The solenoid valves 64, 65 and 66 are small, four ported directional spool valves of the type sold by Rexroth as their model 4WE6. They are single operated, spring loaded, two position valves which as shown in FIG. 3 are in the turbine operating position. Only three of the four ports on each of the solenoid valves 64, 65 and 66 are used. The first port 90. 91 and 92 of solenoid valves 64. 65 and 66, respectively, is connected to the pilot oil supply line 94. The second port 93, 95 and 100 of solenoid valves 64, 65, and 66, respectively are each connected to two of the logic valve pistons; port 93 of solenoid valve 64 is connected to the pistons 96 and 97 of valves 68 and 69, respectively; port 95 of solenoid valve 65 is connected to pistons 98 and 99 of valves 70 and 71, respectively; and port 100 of solenoid valve 66 is connected to pistons 101 and 102 of valves 73 and 74, respectively. The third ports 105, 106 and 107 of solenoid valves 64, 65 and 66, respectively are connected to the pilot oil drain 110 to drain the logic valve piston when de-energized to the trip open position. Accordingly, in the event of an electric power failure to the solenoid valve 64, 65 and 66 they will "fail safe" and trip the turbine 18.

The dump valves 68, 69, 70, 71, 73 and 74 are simple single stepped cylinder valves, with the small bottoms 111, 112, 114, 115, 116, 117, and 118 respectively, acting as a valve; and the larger tops 121, 122, 123, 124, 125 and 126, respectively, acting as the pilot piston. The bottom ends 111, 112, 115, 116, 117 and 118 with their associated steps 131, 132, 133, 134, 135 and 136 respectively, of valves 68, 69, 70, 71, 73 and 74 respectively acts as a pressure area for trip oil to act against, forcing the valves to open when the solenoid valves 64, 65 and 66 open and drop pressure at the upper piston end 96, 97, 98, 99, 101 and 102. The steps 131, 132, 133, 134, 135 and 136 are each formed by the juncture of the bottom smaller cylindrical ends 113, 114, 115, 116, 117 and 118 respectively, and the larger top cylindrical ends 121, 122, 123, 124 and 125, respectively of valves 68, 69, 70, 71, 73 and 74, respectively.

Referring to FIG. 1, the housing of the manifolded solenoid valves 11 is in two pieces, the upper housing piece 140 and lower housing piece 141 bolted together by bolts two of which are shown as 142. The lower housing 141 includes six reamed holes, three of which are shown as 143, 144, and 145 and each including a bottom shoulder corresponding to the shoulders 151, 152, 153, 154, 155, 156 best shown in FIG. 3 and providing the shoulder for logic valves 68, 69, 70, 71, 73 and 74, respectively, which shoulders act as the logic valve seats. The interconnecting passages shown in FIG. 3 are drilled in the housings 140 and 141 with a drain connection 79 at the bottom. The upper housing 140 includes mounting accommodations for the three solenoid valves 64, 65 and 66, each of which includes upper DC electrical terminal boxes such as 157 and 158 and lower valve assemblies such as 159 and 160. Electrical leads such as 161 and 162 connect the governor to the solenoid valves, while manual trip switch 165 is provided as an emergency or backup manual trip remote from the hand trip control 57 located at the operators station. The second manual trip switch 165 facilitates ready access to a trip switch if the operator is away from his station, or for actuation by another person in case of emergency.

A brief description of the operation of the two-out-of-three logic of the manifolded trip solenoid valve assembly 11 may be best understood by reference to FIG. 3. Referring to FIG. 3, the connections shown provide the correct operation of the system as determined by 2 of the three valves responding to the governor trip signal 87. That is, in the event of a failure by any solenoid valve 64, 65, or 66, whether in the actuated or unactuated position, the solenoid valve assembly 11 will nevertheless provide the correct control function. An open position failure of any one will not cause a tripout, and a closed position failure of any one will not prevent tripping, when called for by the other two.

By way of example and summary, the tripping sequence is as follows:

- when the manifolded solenoid valves 11 are actuated, by the turbine governor speed signal 87 or manual trip switch 165; or by hand trip control 57;
- the trip header 8 pressure decays from 95 to 0 PSIG as the dump valve 12 moves open;
- the trip/reset valve 41 trips open as trip header pressure drops to 12.7 PSIG; and
- the main piston 31 starts closing as soon as the dump valve starts opening, and cylinder pressure decays from 90 to 0 PSIG during the stroke.

Thus, the trip/reset valve 41 acts as a hydraulic latch device for the oil trip header 8, such that when the trip solenoid 11 or the hand trip control valve 56 open and drop oil pressure in the header 8, the trip/reset valve 41 opens and maintains oil pressure at near zero in the header 8 until the control is intentionally reset manually by overtraveling the trip/reset valve 41 in the closing, or increasing pressure, regulator valve direction. When reset, the drain 64 is blocked, allowing oil pressure buildup on the opposite end of the trip/reset valve piston 41, thus holding the valve piston 41 in its reset position. When trip action is initiated, the oil pressure drops as the hand trip control valve 56 or the solenoid valve assembly 11 are tripped, whereupon the trip valve spring 38 pushes the trip/reset valve 41 to the open position until reset by turning the pressure regulator valve handknob 43. The trip/reset valve piston 41 is spring loaded to the open position. Oil pressure buildup on the end of projection 88 of the trip/reset valve piston 41 creates more force than the spring, and holds it in the reset position.

While the present invention has been described with respect to certain preferred embodiments thereof, it is to be understood that numerous variations in the details of construction, the arrangement on combination of parts, and the type of materials used may be made without departing from the spirit and scope of the invention.

What I claim is:

1. In a hydraulic control system for a steam turbine wherein turbine speed is controlled through a throttle valve operator to regulate steam delivered to the steam turbine, and a trip mechanism is provided for shutting the steam turbine down, a combined pressure regulator, trip/reset valve comprising:

a pressure regulator valve for controlling the pressure of hydraulic fluid delivered to the throttle valve;

a trip/reset valve adapted to redirect hydraulic fluid from that delivered to the throttle valve to a drain to thereby actuate, the trip mechanism;

a hand trip control integral with said pressure regulator valve and said trip reset valve to connect said hydraulic fluid to said drain to shut said steam turbine down;

means for maintaining the trip mechanism in a tripped position until reset by an operator;

a control member to enable the operator to actuate said pressure regulator valve to selectively control the steam to the turbine, and to reset said trip mechanism by further actuation of said pressure regulator valve to move said trip/reset valve out of said tripped position and to reestablish the pressure of the hydraulic fluid under control of said pressure regulator valve.

2. The control system of claim 1 wherein said control member is a manual control member operatively connected to said pressure regulator valve and said trip/reset valve.

3. The control system of claim 2 wherein said pressure regulator valve and said trip/reset valve are mounted in an operator control housing in substantial alignment to enable axial movement of both by operation of said manual control member.

4. The control system of claim 3 wherein said manual control member is movable after said trip mechanism has been moved to a tripped position to move said pressure regulator valve axially within said housing to push said trip/reset valve to cover said drain to thereby reestablish the pressure in the hydraulic fluid and to enable control of said turbine by said pressure regulator valve.

5. The control system of claim 4 wherein said hand trip is a rotary plug valve comprising:

a cylindrical valve having at least one port in the side thereof; and a second port in said valve connected to said one port;

said one port being aligned with a connection to said trip/reset valve upon rotation of said cylindrical valve.

6. The control system of claim 5 wherein said hand control knob is directly secured to said cylindrical valve whereby said one port is aligned with said connection by a partial rotation of said hand control knob.

7. The control system of claim 5 wherein said partial rotation is approximately 75 degrees.

8. The control system of claim 4 wherein said pressure regulator valve assembly comprises:

a spring separating said pressure regulator valve from said handknob;

a supply line to connect said valve assembly to a source of hydraulic oil;

a first port in said pressure regulator valve positioned to move into variable alignment with said supply line; and a second port in said pressure regulator valve connected to one end of said trip/reset valve and to said throttle valve operator;

said valve assembly being slidable axially by operation of said manual control to control the degree of said alignment between said first port and said supply line to control the hydraulic fluid pressure applied to said throttle valve operator for speed control and to said trip/reset valve.

9. The control system of claim 8 wherein said manual control is a handknob threadably mounted in said housing for axial movement within said housing upon rotation thereof.

10. The control system of claim 8 wherein said trip/reset valve includes a spring positioned at the end of said trip/reset valve remote from said pressure regulator valve to oppose axial movement of said trip/reset valve under pressure of hydraulic fluid from said pressure regulator valve.

11. The control system of claim 10 wherein said spring opposes axial movement of the trip/reset valve in a direction to uncover said drain and trip the turbine when the hydraulic fluid pressure on the opposite side of said valve is below a predetermined level.

12. The control system of claim 11 wherein operation of said handknob slides said pressure regulator valve to selectively enable:

regulation of the hydraulic fluid pressure supplied to said trip throttle valve operator to control the speed of said turbine;

a decrease in the fluid pressure supplied to said trip throttle valve operator to close said trip throttle valve of said turbine; and movement of said trip/reset valve through movement of said pressure regulator valve to close off said trip drain to enable pressure to rebuild in said system to restart the turbine after a trip.

13. The control system of claim 12 wherein said pressure regulator valve is moved by said handknob into direct contact with said trip/reset valve to push said trip/reset valve to cover said drain.

14. The control system of claim 11 wherein said predetermined pressure is approximately 13 pounds per square inch.

15. In a hydraulic control system for a steam turbine wherein turbine speed is controlled through a throttle valve to regulate the steam delivered to said turbine, and redundant trip controls are provided for shutting said steam turbine down, the improvement comprising:

a trip header connected to said trip control to actuate said trip control when the hydraulic pressure in said header decreases below a predetermined value;

a combination pressure regulator and trip/reset valve connected to said trip header;

a trip solenoid assembly with a manual trip switch connected to said trip header;

said manual trip/reset and said combination pressure regulator and trip/reset valve each including a manually operated trip control to enable manual tripping from either of two separated positions;

a direct current control signal which varies in response to the speed of said turbine;

at least three of said trip solenoid valves connected to said control signal for actuation of said trip mechanism when said control signal exceeds a predetermined amount;

said solenoid trip assembly including at least three two stage direct current solenoid actuated valves;

said solenoid valves being connected in a two-out-of-three logic arrangement such that failure of any one of the valves will not affect the correct operation of the other two and of the trip mechanism;

whereby an open signal failure of one valve will not cause a tripout, and a closed position failure of any one will not prevent tripping when called for by the other two.

16. The control system of claim 15 wherein each of said solenoid valves is a two position valve connected to two poppet dump valves in a two stage configuration.

17. The control system of claim 16 wherein said dump valves are of single stepped cylinders configuration with the small cylinder end acting as a valve and the larger cylinder end acting as the pilot piston.

18. The control system of claim 17 wherein trip oil acts against said small cylinder end and the stepped portion of said dump valves where said small cylinder meets said larger cylinder;

whereby the valves open when the solenoid valves open and drop pressure at said piston end.

19. The control system of claim 18 wherein said direct current control signal is provided from the turbine governor without the need for external electric relays.

20. The control system of claim 19 wherein a manual control is provided to actuate said trip solenoid assembly to trip said generator.

21. The control system of claim 20 wherein said solenoids are single operated, two position spool valves.

22. In a steam turbine hydraulic control system for controlling turbine speed and for tripping the turbine, a combination trip throttle valve control comprising:

a housing;

a pressure regulator valve including a piston linearly moveable within said housing;

a trip/reset valve including a piston linearly moveable within said housing in alignment with said pressure regulator valve piston;

a manual regulator control connected to one side of said pressure regulator valve piston to provide a bias to said one side;

a first passageway adapted to connect hydraulic fluid to the other side of said regulator valve piston to oppose the bias of said manual control;

an exit port to deliver hydraulic fluid, the pressure of which varies as said manual regulator control is actuated, to move said pressure regulator valve into varying registration with said first passageway;

said pressure regulating valve having a second passageway which connects said first passageway to said exit port;

whereby the pressure of the hydraulic fluid delivered by said exit port will vary in accordance with actuation of said manual regulator control;

said trip/reset valve piston being biased on one side;

a third passageway adapted to connect another source of hydraulic fluid to said second side of said trip/reset valve to oppose the bias on said one side of said trip/reset valve;

a fourth passageway connected to a drain port blocked by said trip/reset valve piston when the pressure from said another source of hydraulic fluid exceeds a predetermined pressure;

whereby a decrease in the pressure of said another source of hydraulic fluid below said predetermined pressure enables said bias on said trip/reset valve piston to move said trip/reset piston connecting said another source of hydraulic fluid to said fourth passageway to provide a trip position;

said bias on said trip/reset valve maintaining said trip position of said trip/reset valve until pressure from said second source is reestablished to move said trip/reset valve to a position blocking said drain port;

a hand trip valve control on said housing;

a hand trip valve actuated by said hand trip control;

a fifth passageway within said hand trip valve adapted to be connected to a drain and connected to a port in said hand trip valve;

said port in said hand trip valve being aligned with said another source of hydraulic fluid upon actuation of said hand trip valve by said hand trip control;

whereby said another source of hydraulic fluid can flow through said hand trip valve to drain said another source of hydraulic fluid, dropping the pressure thereof, to enable actuation of said trip/reset valve from the untripped position to said tripped position;

continued actuation of said manual regulator valve control moving said pressure regulator valve piston to push said trip/reset valve to close said drain port;

whereby pressure can build up against said second side of said trip/reset valve piston to maintain said trip/reset valve in the untripped position; and said manual regulator control may thereupon be actuated away from contact with said trip/reset valve piston to reestablish the control of said pressure regulator valve by varying the registration of said pressure regulator valve piston with said first passageway.

23. The combination trip throttle valve control of claim 22 wherein a spring is interposed between said pressure regulator valve piston and said manual regulator control to provide said bias.

24. The combination trip throttle valve control of claim 23 wherein said bias on said trip reset/valve piston is a spring bias provided by a spring positioned between said trip/reset valve piston and said housing.

25. The combination trip throttle valve control of claim 24 wherein said manual regulator valve control includes a threaded shaft cooperating with a threaded hole on said housing.

26. The combination trip throttle valve control of claim 25 wherein said pressure regulator valve piston directly contacts said trip/reset valve piston when resetting said trip reset valve from said tripped position.

27. The combination trip throttle valve of claim 26 wherein said hand trip valve comprises a rotary plug valve.

28. The combination trip throttle valve of claim 27 wherein said rotary plug valve includes a hollow cylindrical portion at one end connected to a drain and trip port connected through the side thereof;

whereby rotation of said cylinder moves said drain port into alignment with said another source of hydraulic fluid to connect said another source to drain; and said trip/reset valve piston is biased to uncover said drain port and assume the tripped position.

29. The combination trip throttle valve of claim 28 wherein said hand trip valve control includes a hand trip which is rotated less than one revolution to actuate said trip/reset valve from the untripped to tripped position.

30. The combination trip throttle valve of claim 29 wherein said hand trip valve control includes a drain channel at the upper end thereof leading from the sides of said cylindrical portion to said hollow drain portion.

31. The combination trip throttle valve of claim 30 wherein said hand trip valve control includes at least two ball-spring detents providing positive trip and no-trip positions for said control when rotated such that said ball-spring detents cooperate with holes in the enclosure for said control.

* * * * *